US008098203B2

(12) United States Patent
Ueki

(10) Patent No.: US 8,098,203 B2
(45) Date of Patent: Jan. 17, 2012

(54) ANTENNA AND COMMUNICATION DEVICE HAVING THE SAME

(75) Inventor: Noriyuki Ueki, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 233 days.

(21) Appl. No.: 12/482,742

(22) Filed: Jun. 11, 2009

(65) Prior Publication Data

US 2009/0303133 A1 Dec. 10, 2009

Related U.S. Application Data

(63) Continuation of application No. PCT/JP2007/069374, filed on Oct. 3, 2007.

(30) Foreign Application Priority Data

Dec. 15, 2006 (JP) ..... 2006-338654

(51) Int. Cl.
*H01Q 1/48* (2006.01)
*H01Q 1/38* (2006.01)
*H01Q 5/00* (2006.01)
*H01Q 9/04* (2006.01)

(52) U.S. Cl. ..... 343/700 MS; 343/846; 343/829

(58) Field of Classification Search ..... 343/700 MS, 343/845–6, 848, 729, 893
See application file for complete search history.

(56) References Cited

U.S. PATENT DOCUMENTS 5,146,232 A 9/1992 Nishikawa et al.
5,969,680 A 10/1999 Tsuru et al.
6,043,794 A 3/2000 Faulkner et al.
6,049,314 A 4/2000 Munson et al.
6,140,968 A 10/2000 Kawahara et al.
(Continued)

FOREIGN PATENT DOCUMENTS

JP 3-253106 11/1991
(Continued)

OTHER PUBLICATIONS

International Search Report with English language translation.
(Continued)

*Primary Examiner* — Douglas W Owens
*Assistant Examiner* — Jennifer F Hu
(74) *Attorney, Agent, or Firm* — Keating & Bennett, LLP

(57) ABSTRACT

A plate-like radiation element is arranged above a ground plane with a space from the ground plane. The radiation element 2 resonates at a predetermined low-frequency wavelength $\lambda_1$ and a predetermined high-frequency wavelength $\lambda_2$. A feeding portion for being connected to a feed circuit and a pair of short-circuit portions are provided on peripheral edge portions of the radiation element. The feeding portion is provided on one end of the radiation element. The pair of short-circuit portions for being connected to a ground plane are arranged in areas positioned at opposite sides, on both sides of the feeding portion along peripheral edge directions of the radiation element, where the voltages of high-frequency resonance supplied from the feeding portion to the individual short-circuit portions are zero. The short-circuit portions extend toward the ground plane for being connected to the ground plane. At the other end opposite to the feeding portion of the radiation element is an open end. An electrical length from the one end side to the open end of the radiation element is set to one-half of the high-frequency resonant wavelength $\lambda_2$ of the radiation element.

10 Claims, 8 Drawing Sheets

U.S. PATENT DOCUMENTS

| | | | | |
|---|---|---|---|---|
| 6,218,990 | B1 * | 4/2001 | Grangeat et al. | 343/700 MS |
| 6,496,148 | B2 | 12/2002 | Ngounou Kouam et al. | |
| 6,741,214 | B1 * | 5/2004 | Kadambi et al. | 343/700 MS |
| 6,750,825 | B1 | 6/2004 | Delaveaud et al. | |
| 6,982,673 | B2 | 1/2006 | Yuanzhu | |
| 7,110,719 | B2 | 9/2006 | Horibe et al. | |
| 2004/0196200 | A1 | 10/2004 | Sievenpiper | |

FOREIGN PATENT DOCUMENTS

| | | |
|---|---|---|
| JP | 7-74533 | 3/1995 |
| JP | 2745489 | 2/1998 |
| JP | 10-107535 | 4/1998 |
| JP | 11-234030 | 8/1999 |
| JP | 2000-183637 | 6/2000 |
| JP | 2001-24426 | 1/2001 |
| JP | 3235367 | 9/2001 |
| JP | 3237604 | 10/2001 |
| JP | 2002-57523 | 2/2002 |
| JP | 2002-530908 | 9/2002 |
| JP | 2002-314325 | 10/2002 |
| JP | 3457672 | 8/2003 |
| JP | 2004-96572 | 3/2004 |
| JP | 2004-312166 | 11/2004 |
| JP | 2004-312628 | 11/2004 |

OTHER PUBLICATIONS

Written Opinion with English language translation.

This is Supplemental to the Information Disclosure Statement filed Jun. 11, 2009 with the application. A minor typographical error has been corrected, such as the publication date of JP3237604. All prior art documents have previously been submitted and are therefore not enclosed.

* cited by examiner

DIRECTIVITY IN LOW-FREQENCY RESONANCE

DIRECTIVITY IN HIGH-FREQENCY RESONANCE

ANTENNA AND COMMUNICATION DEVICE HAVING THE SAME

CROSS-REFERENCE TO RELATED APPLICATIONS

This is a continuation under 35 U.S.C. §111(a) of PCT/JP2007/069374 filed Oct. 3, 2007, and claims priority of JP2006-338654 filed Dec. 15, 2006, both incorporated by reference.

BACKGROUND

1. Technical Field

Disclosed is an antenna for being mounted on a ground plane of a board or the like to be inserted and mounted into a personal computer, for example, for performing radio communication such as information communication. Also disclosed is a communication device having the antenna.

2. Background Art

Various antennas have been proposed as antennas for performing, for example, radio communication, such as monopole antennas (for example, see Patent Document 1), patch antennas, and inverted-F antennas.

An antenna shown in FIG. 12 is an inverted-F antenna (see Patent Document 2). In this inverted-F antenna, a triangular plate-like antenna element 42 is arranged above a ground plate 41 with a space therebetween. Short-circuit plates 43 are provided on center portions of individual edges of the antenna element 42. A feeding point 44 is arranged at the barycentric position of the antenna element 42 so that power is fed from this feeding point 44 to the antenna element 42. The short-circuit plates 43 are bent down to be perpendicular to the antenna element 42. The ends of the short-circuit plates 43 are electrically connected to the ground plate 41, so that the center portions of the individual edges of the antenna element 42 are short-circuited to the ground plate 41.

An antenna shown in FIG. 13 is also an inverted-F antenna (see, Patent Document 3). In this inverted-F antenna, a radiation conductor plate 46 is arranged on a grounding conductor of a ground plate 41 or the like. The radiation conductor plate 46 is arranged so as to be substantially parallel to the grounding conductor plane. A feeding conductor plate 47 generally perpendicularly extends from an outer edge of the radiation conductor plate 46 and is connected to a feed circuit. Short-circuit conductors 48 and 49 extend generally perpendicularly from a respective plurality of positions on the outer edges of the radiation conductor plate 46. The electrical length of the radiation conductor plate 46 is set to about one-fourth of a resonant wavelength.

The short-circuit plate 48 extends from an edge, among the edges of the radiation conductor plate 46, that is adjacent to the edge provided with the feeding conductor plate 47. The short-circuit conductor plate 49 extends from an edge, among the edges of the radiation conductor plate 46, that is the same as the edge provided with the feeding conductor plate 47. The short-circuit conductor plate 48 and the short-circuit conductor plate 49 are arranged on respective parts located at different distances from the feeding conductor plate 47.

Patent Document 1: Japanese Patent No. 3457672

Patent Document 2: Japanese Patent No. 2745489

Patent Document 3: Japanese Unexamined Patent Application Publication No. 2004-312166

However, in the inverted-F antennas described above, the null point in the directivity is obtained in a plane horizontal to the ground plate 41. Thus, there has been a problem that communication may fail due to the orientation of the antenna.

In addition, to increase the frequency band for the above inverted-F antenna, it is necessary to increase the height of the antenna.

In addition, in the inverted-F antennas shown in both FIG. 12 and FIG. 13, short-circuit components such as the short-circuit plates 43 and the short-circuit conductor plates 48 and 49 are formed at asymmetrical positions. Therefore, for the above inverted-F antennas shown in FIG. 12 and FIG. 13, restrictions are imposed on the antenna mounting direction. Further, to increase the antenna efficiency and frequency band for the above inverted-F antennas shown in FIG. 12 and FIG. 13, it is necessary to provide the short-circuit components near the edges of the board for utilizing resonance of the board. Therefore, there has been a problem that restrictions are imposed on the antenna mounting position.

In addition, it is difficult to provide a single patch antenna with a low-profile appearance and wide band characteristics. Therefore, the above monopole antenna disclosed in Patent Document 1 has a problem in that it is difficult to provide matching with a communication circuit when the dielectric constant of a dielectric material to be used is large.

SUMMARY

The disclosed embodiments address the above problems. Accordingly, an antenna may include a plate-like radiation element which is arranged above a ground plane with a space from the ground plane and resonates at a predetermined low-frequency wavelength $\lambda_1$ and a predetermined high-frequency wavelength $\lambda_2$, wherein a feeding portion for being connected to a feed circuit and a pair of short-circuit portions are provided on peripheral edge portions of the radiation element, wherein the feeding portion is provided on one end side of the radiation element, wherein the pair of short-circuit portions are arranged in areas positioned at opposite sides with respect to the feeding portion along peripheral edge directions of the radiation element, where the voltages of high-frequency resonance supplied from the feeding portion to the individual short-circuit portions are zero, wherein the short-circuit portions extend toward the ground plane side for being connected to the ground plane, wherein the other end opposite to the feeding portion of the radiation element serves as an open end, and wherein an electrical length from the one end side to the open end of the radiation element is set to one-half of the high-frequency resonant wavelength $\lambda_2$ of the radiation element.

In addition, a communication device of this embodiment includes an antenna having a configuration as described herein.

The antenna is configured to have a plate-like radiation element disposed above a ground plane with a space from the ground plane, and a feeding portion and a pair of short-circuit portions which are provided on peripheral edge portions of the radiation element. The radiation element resonates at a predetermined at a predetermined low-frequency wavelength $\lambda_1$ and a predetermined high-frequency wavelength $\lambda_2$. The pair of short-circuit portions are arranged in areas positioned at opposite sides with respect to the feeding portion along peripheral edge directions of the radiation element, where the voltages of high-frequency resonance supplied from the feeding portion to the individual short-circuit portions are zero. Thus, the antenna can produce resonance in a monopole antenna mode or a loop antenna mode by a current corresponding to the low-frequency wavelength $\lambda_1$. In addition, in the antenna, the other end side opposite to the feeding portion of the radiation element serves as an open end, and the electrical length from the one end side to the open end of the radiation element is set to one-half of the high-frequency resonant wavelength $\lambda_2$ of the radiation element. Thus, the antenna can produce resonance in a patch antenna mode by a current corresponding to the wavelength $\lambda_2$.

That is, the antenna can produce two types of resonance, which are resonance in a monopole antenna mode or a loop antenna mode, and resonance in a patch antenna mode. Accordingly, the antenna can realize a low-profile height and a wide frequency band. In addition, since the low-frequency one of the two types of resonance is not an inverted-F antenna mode, no null point is present in the horizontal direction. Therefore, the antenna can enable reception and transmission of radio waves in all horizontal plane directions.

In addition, in the antenna, an extension portion extending toward the ground plane side is formed on the open end side of the radiation element and an end of the extension portion serves as an open end, and a capacitance contributing to the electrical length of the high-frequency resonant wavelength $\lambda_2$ is formed between the open end and the ground plane. An antenna having this configuration can form the capacitance and have a large antenna length. Thus, the high-frequency resonant wavelength can be shifted to the low-frequency side, and downsizing of the antenna can be realized.

Further, with an antenna in which at least one of the feeding portion, the short-circuit portions, and the extension portion is formed so that its width is changed continuously or stepwisely, the following advantages can be achieved. Specifically, with the configuration in which the width of the feeding portion increases as it approaches the radiation element side, matching can be provided over a wide frequency range. In addition, the configuration in which the width of the short-circuit portions is changed can decrease the frequency of the low-frequency resonance. Further, the configuration in which the width of the extension portion is changed can realize a wide frequency band.

Further, with the configuration in which a notch portion is formed in at least one of the feeding portion, the short-circuit portions, and the extension portion, the following advantages can be achieved. Specifically, by forming a notch portion such as a slit in a part where current flow concentrates, an inductive characteristic can be increased and thus the resonant frequency can be efficiently reduced.

In addition, in the antenna, by forming a matching element or a matching slit, the following advantages can be achieved. Specifically, it is not necessary to provide an external component for matching the impedance of a feed circuit connected to the feeding portion with the impedance of the antenna (component for adjusting an inductive characteristic or a capacitive characteristic), which allows space saving.

Further, in the antenna, by providing a dielectric substrate between the ground plane and the radiation element, downsizing of the antenna can be achieved.

Further, since the antenna provides the above advantages, a communication device having the antenna can realize an increased frequency band. In particular, a communication device capable of reception and transmission of radio waves in all horizontal plane directions (ground plane directions) can be formed.

Other features and advantages will become apparent from the following description of embodiments of the antenna, which refers to the accompanying drawings.

DETAILED DESCRIPTION

Reference Numerals

Figure 1:
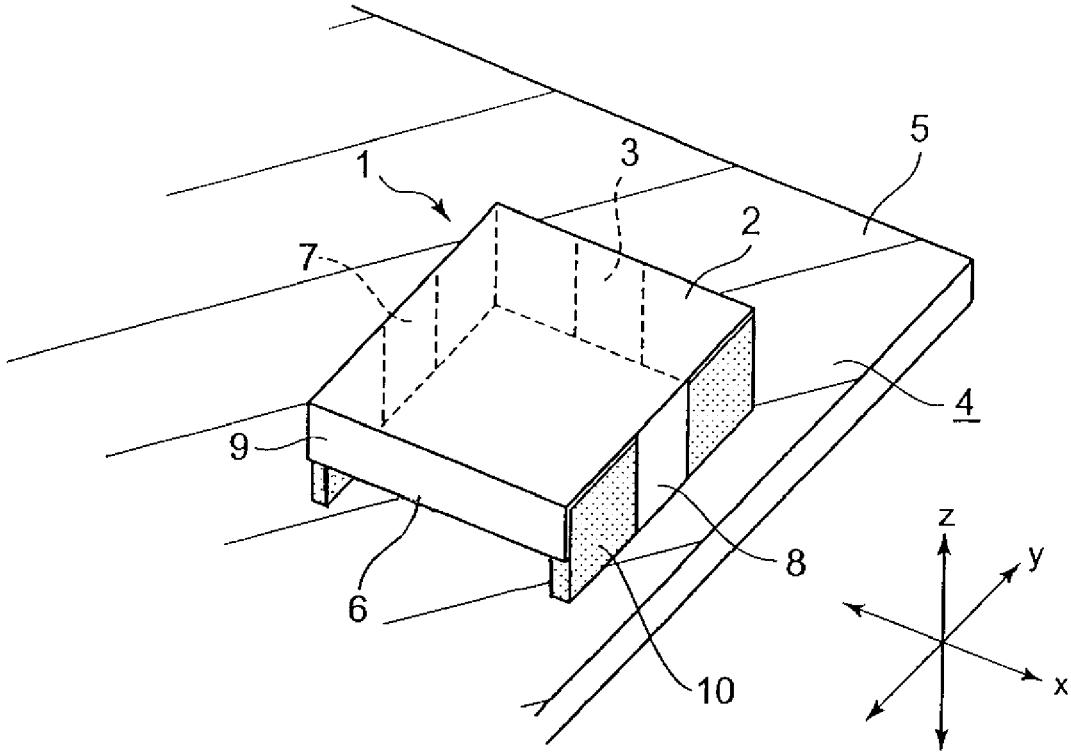
FIG. 1 is a diagram for illustrating an antenna of a first embodiment.

1 antenna
2 radiation element
3 feeding portion
4 circuit board
5 ground plane
6 open end
7, 8 short-circuit portions
9 extension portion
10 dielectric substrate
13, 14, 15 slits
18, 19 bent portions
20 matching slits In the following, embodiments will be described with reference to the drawings.

In FIG. 1, an antenna 1 of a first embodiment is illustrated together with a circuit board 4 by a schematic perspective view. This antenna 1 is applied to a data communication device or the like having the circuit board 4, as illustrated in a plan view of FIG. 2, for example. A ground plane 5 is formed on a top surface of the circuit board 4. Note that in FIG. 1 and FIG. 2, horizontal directions (the directions in which the ground plane 5 is formed) are defined by an x-axis and a y-axis orthogonal to each other, and a direction orthogonal to the x-axis and the y-axis is defined as a z-axis.

The antenna 1 has a plate-like radiation element 2 arranged above the ground plane 5 with a space from the ground plane 5. A feeding portion 3 to be connected to a feed circuit (not shown) and a pair of short-circuit portions 7 and 8 are provided on peripheral edge portions of the radiation element 2. In this embodiment, the radiation element 2 has a square shape, and the short-circuit portions 7 and 8 are arranged at opposing positions on middle portions of the radiation element 2 in the Y-axis direction. In the first embodiment, with such a configuration in which the radiation element 2 has a square shape and the short-circuit portions 7 and 8 are arranged at opposing positions, the mounting orientation of the antenna 1 can be freely set.

The radiation element 2 resonates at a predetermined low-frequency wavelength $\lambda_1$ and a predetermined high-frequency wavelength $\lambda_2$. The feeding portion 3 is provided at one end of the radiation element 2, and the feeding portion 3 extends toward the ground plane 5. The pair of short-circuit portions 7 and 8 are arranged in areas positioned at opposite sides on both sides of the feeding portion 3 along peripheral edge directions of the radiation element 2, at positions where the voltages of high-frequency resonance supplied from the feeding portion 3 to the individual short-circuit portions 7 and 8 are zero. The short-circuit portions 7 and 8 extend toward the ground plane 5 for being connected to the ground plane 5.

The other end of the radiation element 2, which is opposite to the end where the feeding portion 3 is formed, provides an open end 6. An extension portion 9 extending toward the ground plane 5 is formed on the open end 6, and the end of the extension portion 9 nearest the ground plane 5 serves as the open end 6. A capacitance which contributes to the electrical length of the high-frequency resonant wavelength $\lambda_2$ is formed between the open end 6 and the ground plane 5. The electrical length from the one end of the radiation element 2 to the open end 6 is set to be one-half of the high-frequency resonant wavelength $\lambda_2$.

Figure 3:
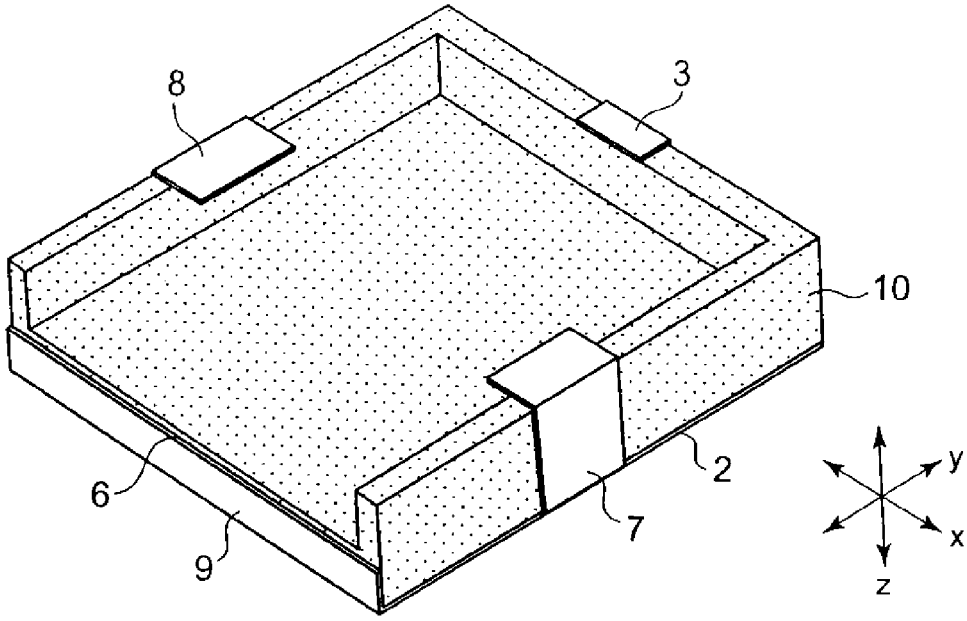
FIG. 3 is an explanatory diagram showing an antenna of the first embodiment by a perspective view taken from a ground plane side.

In addition, in the present embodiment, a dielectric substrate 10 is provided between the radiation element 2 and the ground plane 5. As best illustrated in FIG. 3, this dielectric substrate 10 is formed in such a manner that except for its peripheral edge portions, it is spaced away from the ground plane 5. The dielectric substrate 10 is formed along the bottom surface of the radiation element 2 (the surface facing the ground plane 5) and along the peripheral edge portions of the radiation element 2. That is, the areas on which the dielectric substrate 10 is formed correspond to the areas on which the feeding portion 3 and the short-circuit portions 7 and 8 are formed, where current flowing through the radiation element 2 concentrates.

The antenna 1 of the present embodiment is configured as described above. In this antenna 1, as indicated by solid arrows A in FIG. 4*a* and solid arrows A in FIG. 4*b*, a resonant path extends through, in that order, the feeding portion 3, the radiation element 2, and the short-circuit portions 7 and 8. The inventor created a prototype of the antenna 1 and analyzed electric field distribution by changing the input phase (for example, at 90 degrees and 270 degrees). As a result, at both the input phases, strong radiation of radio waves was observed in the feeding electrode 3 side. Consequently, it was found that the antenna 1 operates in a monopole antenna mode or a loop antenna mode at the low-frequency resonant wavelength.

Figure 4A:
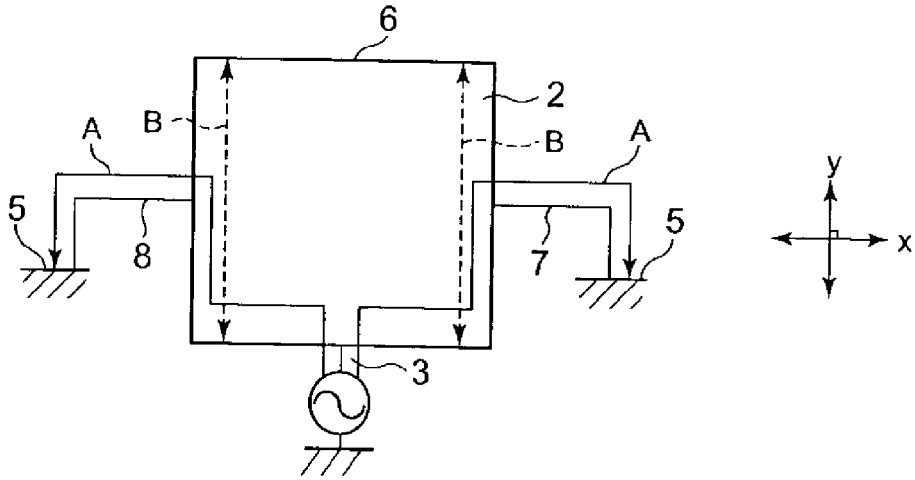
FIG. 4*a* is a diagram for illustrating the operation of an antenna of the first embodiment.
Figure 4B:
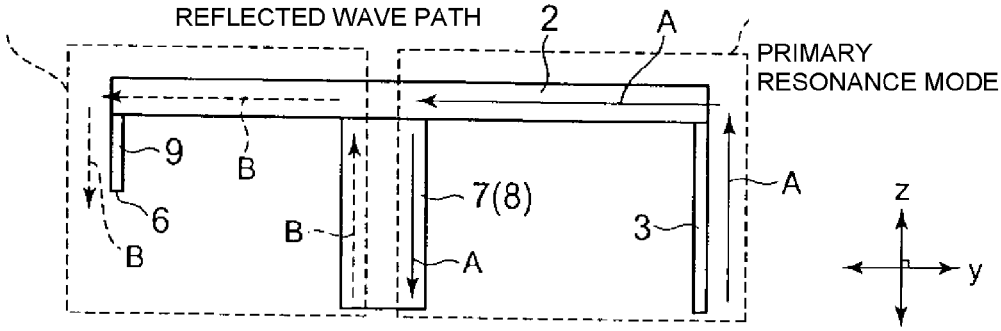
FIG. 4*b* is a diagram for illustrating the operation of an antenna of the first embodiment.

Radiation of radio waves of the low-frequency resonant wavelength was also observed in the direction toward the open end 6 of the radiation element 2, as indicated by broken arrows B in FIG. 4*b*. However, the reason for this may be because reflected waves from the short-circuit portions 7 and 8 are generated in paths toward the open end 6 of the radiation element 2.

On the other hand, as indicated by broken arrows B in FIG. 4*a*, a resonant path in the high-frequency band extends from the one end side to the open end 6 side of the radiation element 2. The inventor created a prototype of the antenna 1 and analyzed electric field distribution by changing the input phase (for example, at 90 degrees and 270 degrees). As a result, it was observed that the electric field from the radiation element 2 toward the ground plane 5 was directed in opposite directions with respect to the positions where the short-circuit portions 7 and 8 are formed. Consequently, it was found that the antenna 1 operates in a patch antenna mode at the high-frequency resonant wavelength, in which resonance of a standing wave was one-half of the resonant wavelength ($\lambda/2$ of the resonant frequency).

Figure 2:
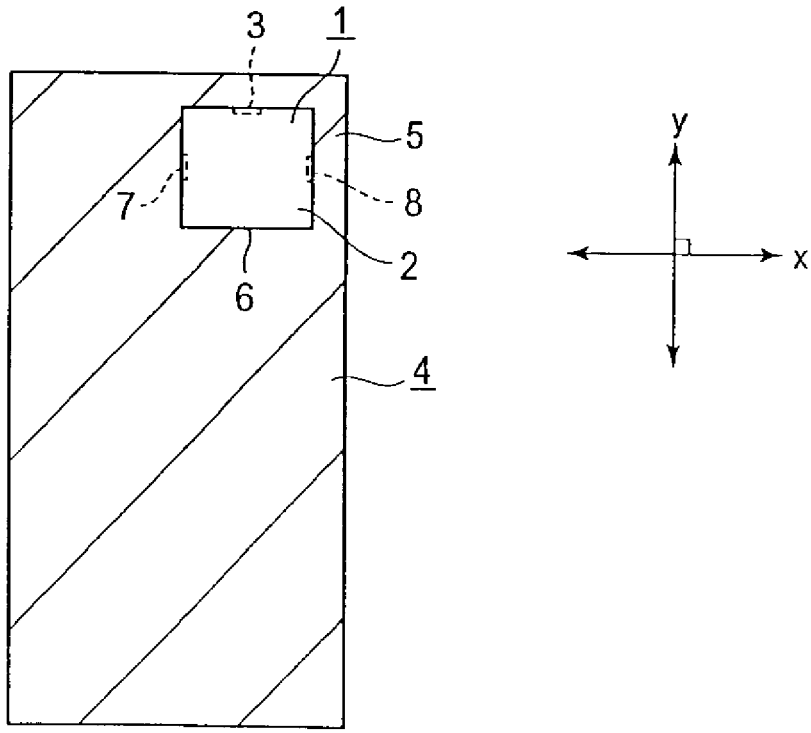
FIG. 2 is a diagram illustrating an example of a mounting position in a case where an antenna is mounted on a circuit board.

Note that the prototype antenna 1 was formed on a circuit board 4 of 45 mm×100 mm. The antenna size is 20 mm×20 mm and has a low-profile height of 6.5 mm. The dielectric constant of the dielectric substrate 10 was set to 6.45. The antenna mounting position was as illustrated in FIG. 2, and the low-frequency resonant frequency was set to 3400 MHz, and the high-frequency resonant frequency was set to 4600 MHz.

Figure 5:
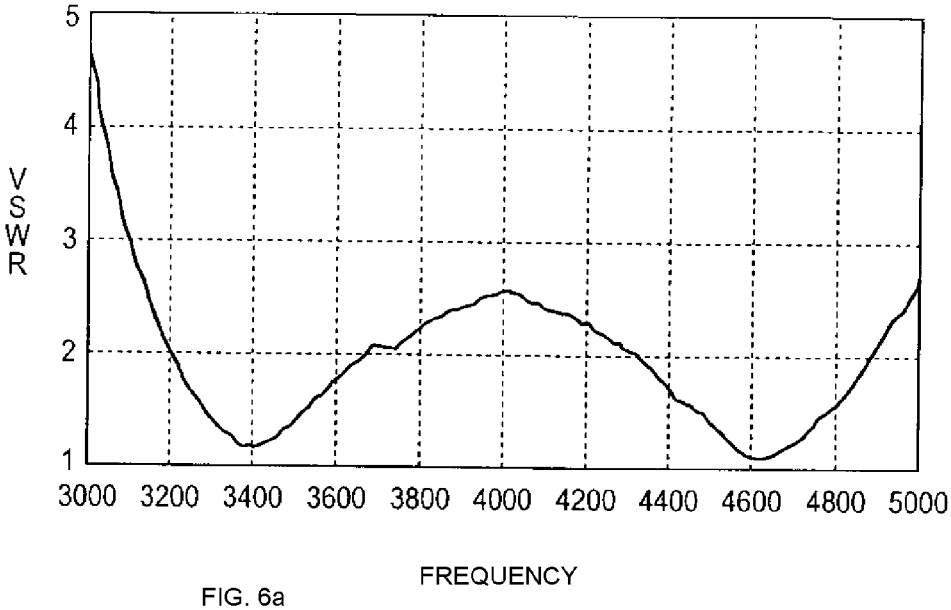
FIG. 5 is a graph showing a VSWR characteristic in a prototype example of an antenna of the first embodiment.

In addition, the VSWR (voltage standing wave ratio) of the prototype antenna 1 was measured, and a result shown in FIG. 5 was obtained. That is, the frequency range for Low-Band UWB (ultra wide band) satisfying VSWR≦3 is 3.1 GHz-4.8 GHz, and thus it was observed that low VSWR characteristics were achieved over a wide frequency range.

Figure 6A:
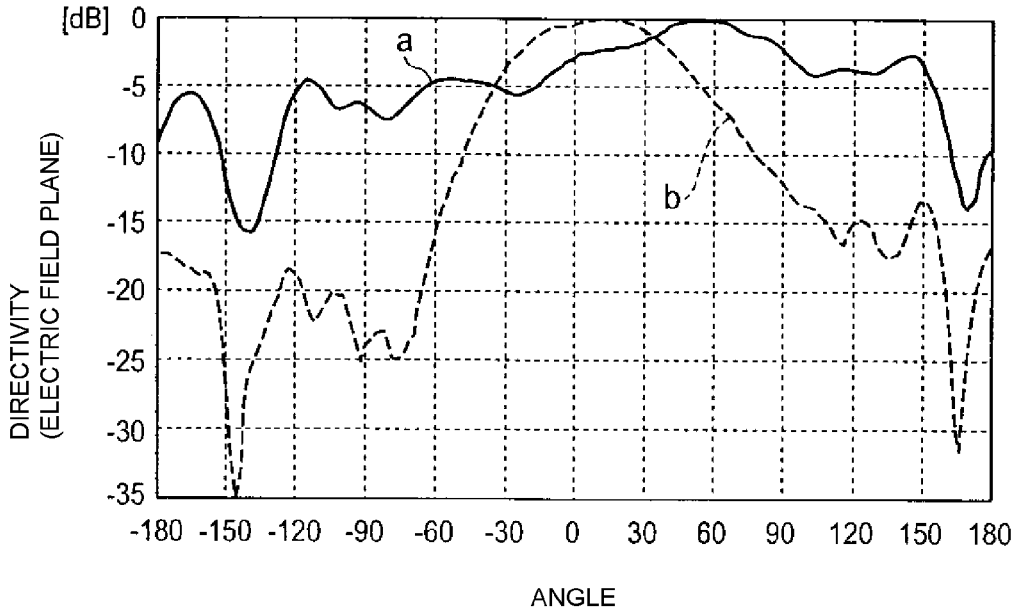
FIG. 6*a* is a graph showing an example in which directivity in a z-y plane of the electric field plane of the antenna prototype example is obtained.
Figure 6B:
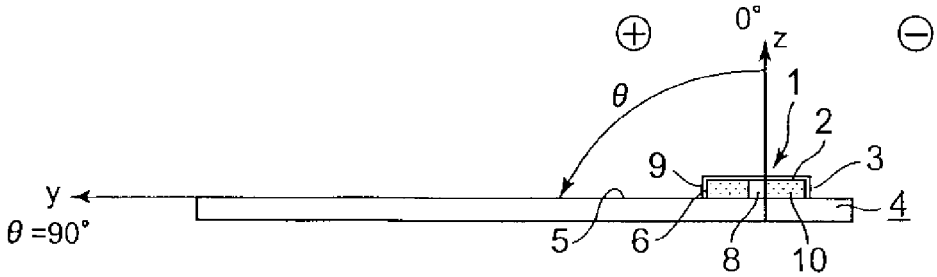
FIG. 6*b* is a diagram for illustrating angles of directivity in a z-y plane of the electric field plane of the antenna prototype example.

Further, as illustrated in FIG. 6*a*, the directivity of electric field plane on the y-z plane at two resonant points was examined, and a result as indicated by a characteristic line a and a characteristic line b in FIG. 6 was obtained. Note that the characteristic line a represents the low-frequency resonance side (3400 MHz) and the characteristic line b represents the high-frequency resonance side (4600 MHz). As illustrated in FIG. 6*b*, an angle θ of 0 degrees corresponds to the z-axis direction extending upward from the ground plane 5, an angle θ leftward from the z-axis is a positive (+) angle and an angle θ rightward from the z-axis is a negative (−) angle. The y-axis direction extending from the one end side (the side on which the feeding portion 3 is formed) to the other end side of the antenna 1 is 90 degrees and the y-axis direction extending from the other end side to the one end side of the antenna 1 is −90 degrees.

Figure 7A:
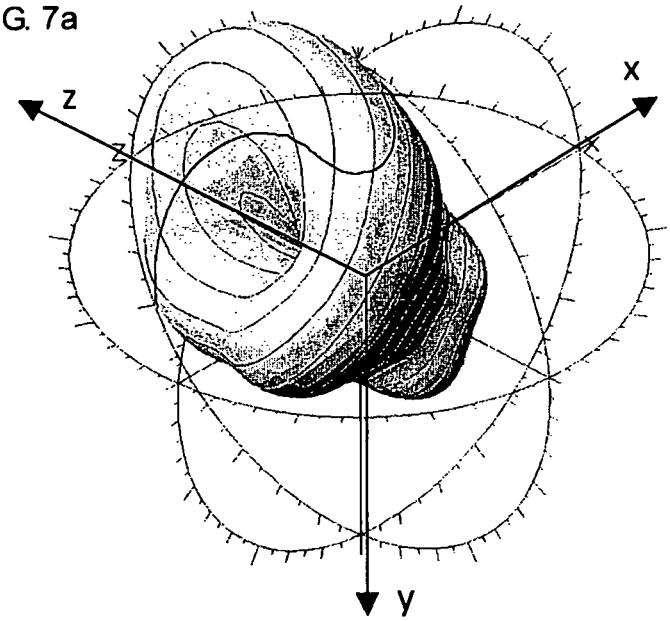
FIG. 7*a* is a diagram illustrating an example in which electric field planes in low-frequency resonance of the antenna prototype example is obtained in three dimensions.
Figure 7B:
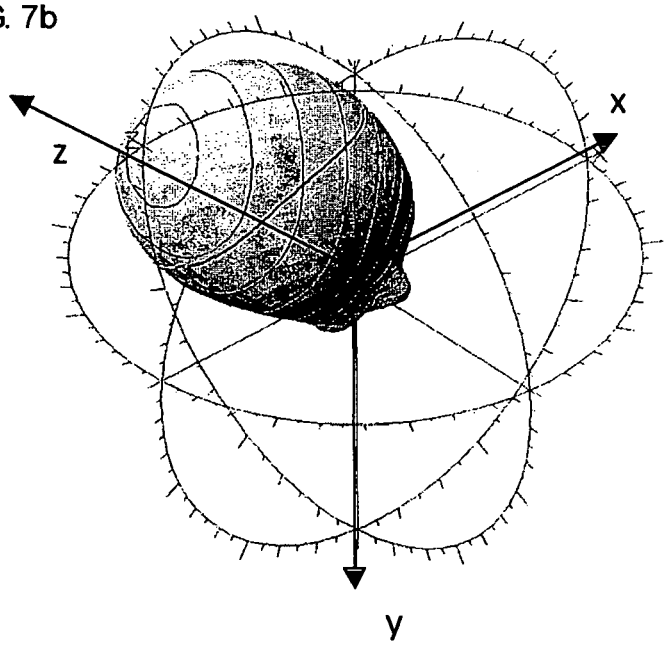
FIG. 7*b* is a diagram illustrating an example in which electric field planes in high-frequency resonance of the antenna prototype example is obtained in three dimensions.

Further, three-dimensional directivity in the x-axis, y-axis, and z-axis directions of the antenna 1 was calculated by analysis. As a result, the directivity of the low-frequency resonance was obtained as shown in FIG. 7*a*, and the directivity of the high-frequency resonance was obtained as shown in FIG. 7*b*. That is, it was observed that in the low-frequency resonance, reception and transmission of radio waves were enabled in all directions in the horizontal plane directions.

In the following, a second embodiment will be described. In the description of the second embodiment, parts having the same names as those in FIG. 1 are designated by the same reference numerals, and the redundant description of such common parts will be omitted.

Figure 8A:
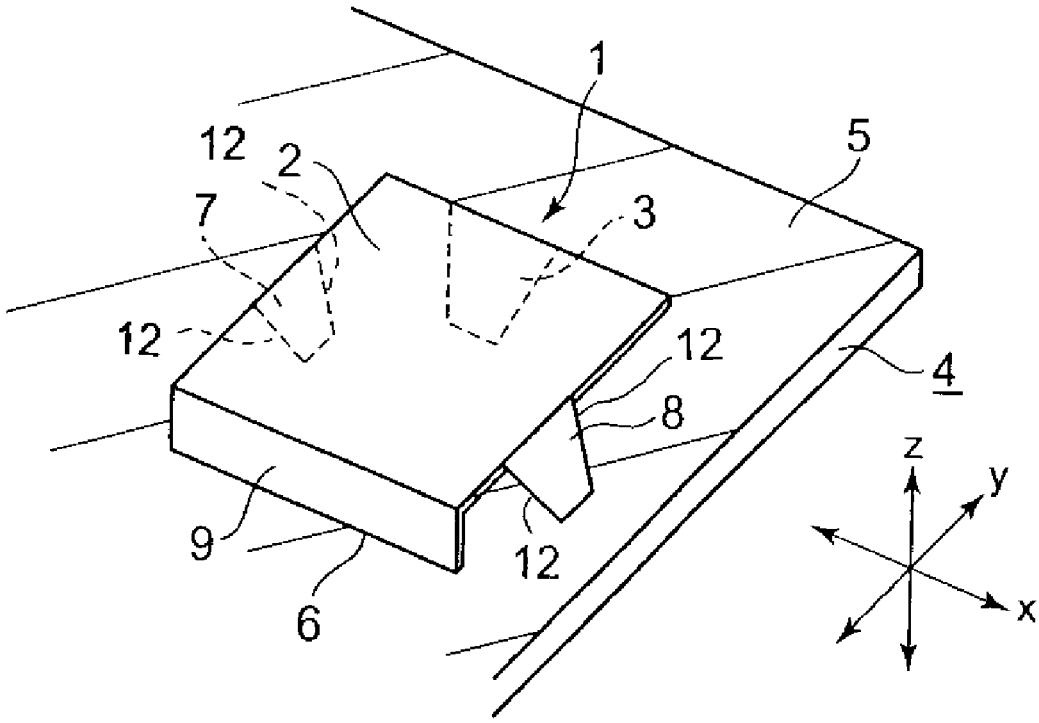
FIG. 8*a* is a diagram for illustrating a perspectively visualized configuration of an antenna of a second embodiment.

In FIG. 8*a*, an antenna 1 of the second embodiment is illustrated together with a circuit board 4 by a schematic perspective view. The second embodiment is configured in a generally similar manner to the first embodiment. The second embodiment is different from the first embodiment in that a feeding portion 3 and short-circuit portions 7 and 8 are formed so that their widths become narrower as they approach the ground plane 5 (and wider as they approach the radiation element 2). Note that in the second embodiment, each of the feeding portion 3 and the short-circuit portions 7 and 8 is left-right symmetrically formed. The dielectric substrate 10 is omitted from the illustration of FIG. 8*a*.

The second embodiment is configured as described above. The second embodiment can also produce effects similar to those in the first embodiment. In addition, in the second embodiment, it is possible to provide matching over a wide frequency range by gradually increasing the width of the feeding portion 3 as it approaches the radiation element 2. Moreover, in the second embodiment, it is possible to increase the length of sides 12 of the short-circuit portions 7 and 8 and thus decrease the frequency by changing the width of the short-circuit portions 7 and 8.

Figure 8B:
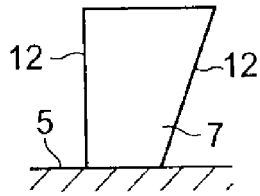
FIG. 8*b* is a diagram for illustrating another configuration example of a short-circuit portion.
Figure 8C:
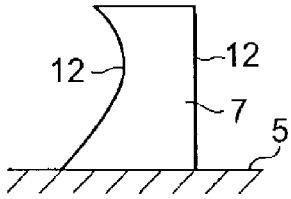
FIG. 8*c* is a diagram for illustrating another configuration example of a short-circuit portion.

The shape of the short-circuit portions 7 and 8 may be left-right asymmetric, as in the short-circuit portion 7 shown in each of FIG. 8*b* and FIG. 8*c*. Thus, by changing the lengths of the two sides 12 of each of the short-circuit portions 7 and 8, the current path can be made complicated and the frequency band can be increased.

In the following, a third embodiment will be described. In the description of the third embodiment, parts having the same names as those in the first and second embodiments are designated by the same reference numerals, and the redundant description of such common parts will be omitted.

Figure 9:
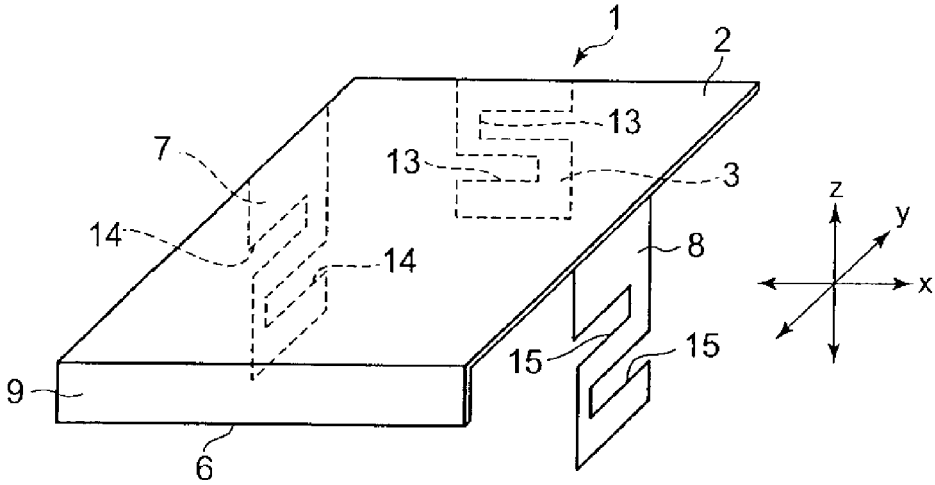
FIG. 9 is a diagram for illustrating an antenna of a third embodiment.

In FIG. 9, an antenna 1 of the third embodiment is illustrated by a schematic perspective view. The third embodiment is configured generally similarly to the first embodiment. The third embodiment is different from the first embodiment in that slits 13, 14, and 15 are formed as notch portions in a feeding portion 3 and short-circuit portions 7 and 8, respectively. Note that in FIG. 9, illustration of a dielectric substrate 10 is omitted.

The slits 13 of the feeding portion 3 are formed in the X direction, and the slits 14 and 15 of the short-circuit portions 7 and 8 are formed in the Y direction. Each of the slits 13 to 15 is formed to have a rectangular shape. Note that the shapes or the number of the slits 13 to 15 are not particularly limited, and are to be set according to need. However, it is preferable that the slits 14 and 15 formed in the short-circuit portions 7 and 8 have the same shape as each other.

The third embodiment is configured as described above and can produce effects similar to those in the first embodiment. In addition, in the third embodiment, by forming the slits 13 to 15 the resonant frequency can be decreased.

In the following, a fourth embodiment will be described. In the description of the fourth embodiment, parts having the same names as those in the first to third embodiments are designated by the same reference numerals, and the redundant description of such common parts will be omitted.

Figure 10:
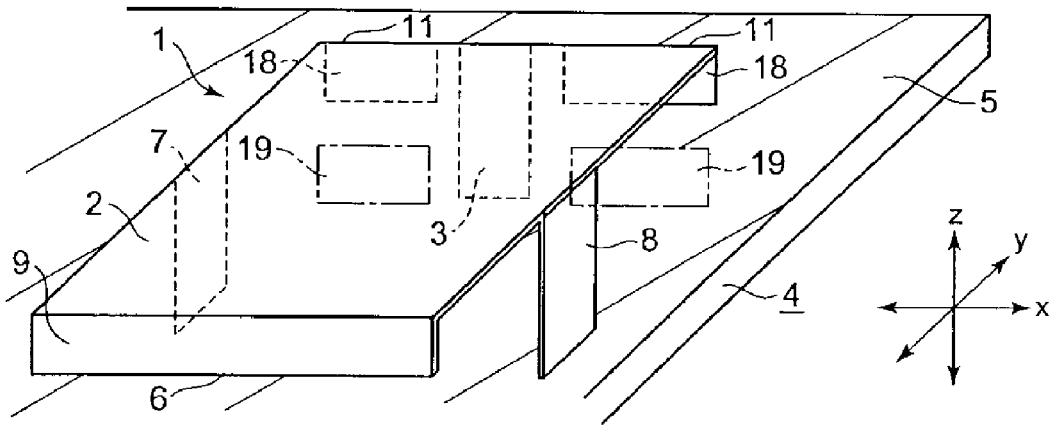
FIG. 10 is a diagram for illustrating an antenna of a fourth embodiment.

In FIG. 10, an antenna 1 of the fourth embodiment is illustrated together with a circuit board 4 by a schematic perspective view. The fourth embodiment is configured generally similarly to the first embodiment. The fourth embodiment is different from the first embodiment in that rectangular-shaped bent portions 18 are provided. The bent portions 18 are formed on peripheral edge portions at one end of the radiation element 2 where the feeding portion 3 is formed. In addition, the bent portions 18 are arranged at positions at opposite sides with respect to the feeding portion 3 and extend toward the ground plane 5. The bent portions 18 are arranged spaced apart from the feeding portion 3 and form matching elements for matching the impedance of a feed circuit connected to the feeding portion 3 with the impedance of the antenna. Note that in FIG. 10, illustration of the dielectric substrate 10 is omitted.

The fourth embodiment can also produce effects similar to those in the above first embodiment. Further, in the fourth embodiment, no external part for matching is necessary since the bent portions 18 form matching elements, and thus space-saving can be achieved.

In addition, instead of forming the bent portions 18 on the peripheral edge portions 11 at opposite sides with respect to the feeding portion 3, an arrangement as indicated by broken lines in FIG. 10 may be provided. That is, bent portions 19 may be formed on the ground plane 5 facing the peripheral edge portions 11 so as to be directed toward the peripheral edge portions 11. Thus, matching elements may be formed by these bent portions 19. It is also possible that both the bent portions 18 and 19 are provided to form matching elements. Note that the shape, size, etc., of the bent portions 18 and 19 can be set according to need.

Figure 11:
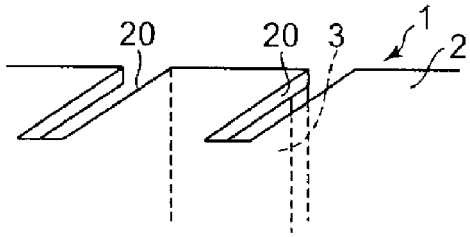
FIG. 11 is a diagram for illustrating a configuration example of matching slits in an antenna of another embodiment.
Figure 12:
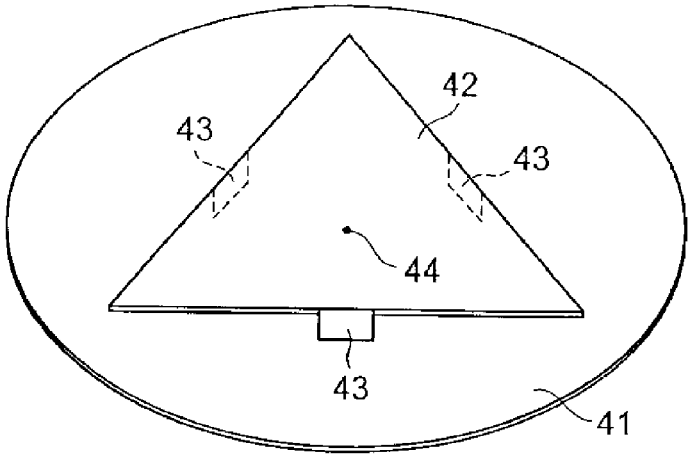
FIG. 12 PRIOR ART
FIG. 12 is a diagram for illustrating an antenna disclosed in Patent Document 2.
Figure 13:
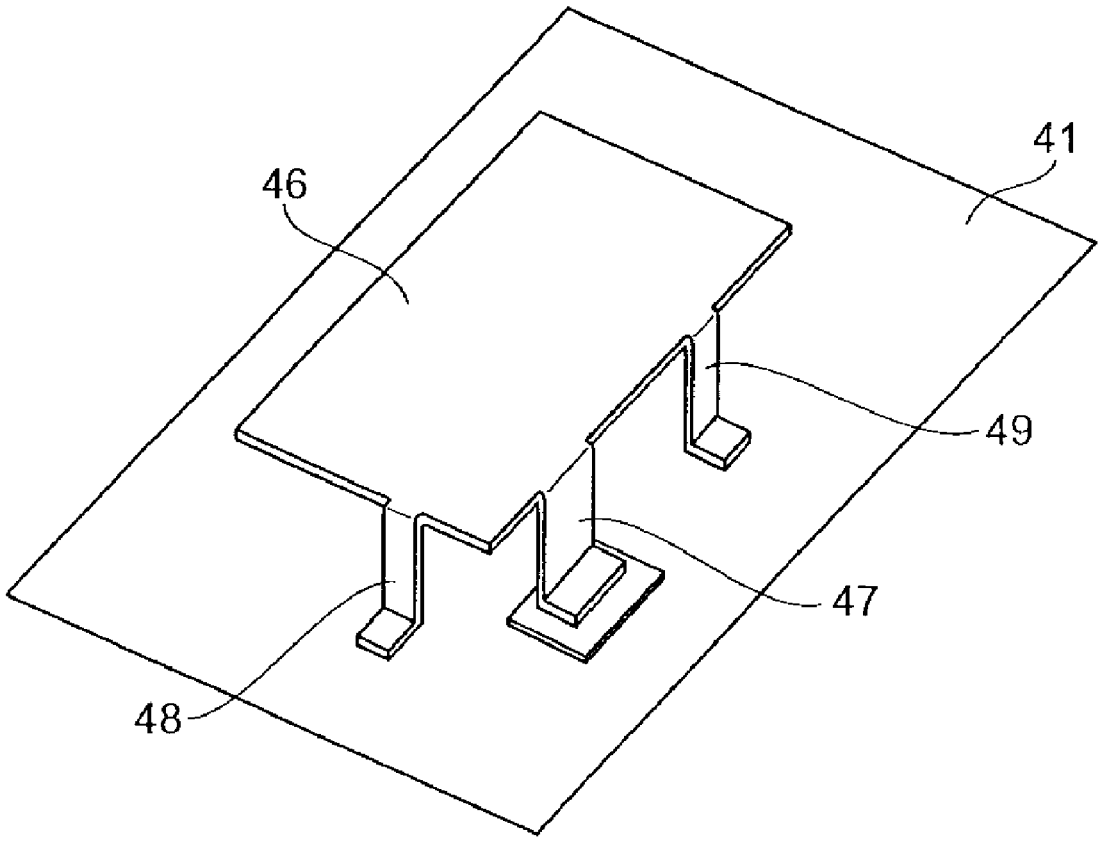
FIG. 13 PRIOR ART
FIG. 13 is a diagram for illustrating one of antennas disclosed in Patent Document 3.

In addition, as illustrated in FIG. 11, slits 20 for matching may be formed in a radiation element 2 at opposite sides of the feeding portion 3, so as to extend from the one end toward the other end of the radiation element 2. The matching slits 20 match the impedance of a feed circuit connected to the feeding portion 3 with the impedance of the antenna. This configuration can also produce effects similar to those in the fourth embodiment.

Note that the present invention is not limited to the individual embodiments described above and may employ various configurations. For example, every one of the above embodiments has the dielectric substrate 10. However, the dielectric substrate 10 may be omitted. In addition, even when the dielectric substrate 10 is provided, the shape of the dielectric substrate 10 is not limited to the one in which a center section is cut out, as in the case of the above embodiments. Thus, the shape of the dielectric substrate 10 is not particularly restricted and may be set according to need.

Figure 8D:
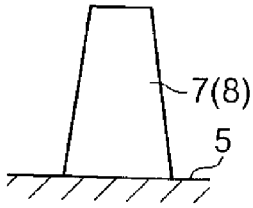
FIG. 8*d* is a diagram for illustrating another configuration example of a short-circuit portion.
Figure 8E:
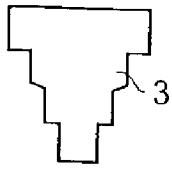
FIG. 8*e* is a diagram for illustrating another configuration example of a feeding portion.

In addition, the shapes of the feeding portion 3, the short-circuit portions 7 and 8, and the extension portion 9 are not particularly restricted and may be set according to need. For example, as illustrated in FIG. 8*d*, each of the short-circuit portions 7 and 8 may be formed such that its width continuously increases as it approaches the ground plane 5. In addition, each of the feeding portion 3, the short-circuit portions 7 and 8, and the extension portion 9 may be left-right asymmetric. Further, as in the feeding portion 3 illustrated in FIG. 8*e*, each of the feeding portion 3, the short-circuit portions 7 and 8, and the extension portion 9 may be formed such that its width is stepwisely changed. In addition, all or one of the feeding portion 3, the short-circuit portions 7 and 8, and the extension portion 9 may be changed. Further, the extension portion 9 may be omitted.

Further, in the above embodiments, the short-circuit portions 7 and 8 are arranged at opposing positions. However, the short-circuit portions 7 and 8 may not necessarily be arranged at opposing positions. Specifically, the pair of the short-circuit portions 7 and 8 are to be arranged in areas positioned at opposite sides with respect to the feeding portion 3 along peripheral edge directions of the radiation element 2, where the voltages of high-frequency resonance supplied from the feeding portion 3 to the individual short-circuit portions 7 and 8 are zero.

With the configuration in which the short-circuit portions 7 and 8 are arranged at positions on the peripheral edge portions of the radiation element 2 which are closer to the open end 6 of the radiation element 2 than the middle portions in the y direction, a further increased frequency band can be realized. In addition, with the configuration in which the short-circuit portions 7 and 8 are arranged at positions on the peripheral edge portions of the radiation element 2 which are closer to the feeding portion 3 than the middle portions in the y direction, operation of an inverted-F antenna may also be enabled.

Further, in each of the above embodiments, the radiation element 2 has a square shape. However, the radiation element 2 may have a rectangular shape. In addition, the radiation element 2 may have a shape of a square or a rectangle having rounded or notched corners. Further, the radiation element 2 may have a circular shape such as a circle or an oval, and the shape may be set according to need. However, the radiation element 2 preferably has a rectangular shape, which facilitates adjustment of the resonant frequency.

Further, in each of the above embodiments, the ground plane 5 is formed on a top surface of the circuit board 4. However, it is also possible to form the ground plane 5 in the interior or on a bottom surface of the circuit board 4.

Further, while the above description illustrates the example in which the antenna 1 of each of the above embodiments is applied to a data communication device, the antenna of the present invention can be applied to various radio communication devices.

An antenna as described herein is a ground mounted, low-profile antenna which can realize a wide frequency band. Thus, the antenna is preferable to serve as an antenna to be mounted on a ground plane of a board or the like to be inserted and mounted into a personal computer or the like. In addition, a communication device having the antenna is preferably applied to a personal computer or the like and is preferable to serve as a communication device for performing radio communication such as information communication.

Although particular embodiments have been described, many other variations and modifications and other uses will become apparent to those skilled in the art. Therefore, the present invention is not limited by the specific disclosure herein.

What is claimed is:

1. An antenna comprising:

a plate-shaped radiation element arranged above a ground plane with a space from the ground plane and arranged to resonate at a predetermined low-frequency wavelength $\lambda_1$ and a predetermined high-frequency wavelength $\lambda_2$, wherein:

a feeding portion connected to a feed circuit and a pair of short-circuit portions connected to the ground plane are provided on peripheral edge portions of the radiation element, the feeding portion is provided on one end of the radiation element, the pair of short-circuit portions are positioned in respective portions of a pair of opposed lateral sides, the one end including the feeding portion being positioned between said pair of lateral sides along said peripheral edge portions of the radiation element, where voltages of high-frequency resonance supplied from the feeding portion to individual ones of the pair of short-circuit portions are zero, the pair of short-circuit portions extend toward the ground plane for being connected to the ground plane, the other end opposite to the feeding portion of the radiation element serves as an open end, an electrical length from the one end to the open end of the radiation element is set to one-half of the high-frequency wavelength $\lambda_2$ of the radiation element, a resonance frequency of the low-frequency wavelength $\lambda_1$ is determined by an electrical length of a path from the feeding portion to the pair of short-circuit portions and occurs in a monopole antenna mode or a loop antenna mode, and a resonance frequency of the high-frequency wavelength $\lambda_2$ is determined by the electrical length from the one end to the open end of the radiation element and occurs in a patch antenna mode.

2. The antenna according to claim 1, wherein:

an extension portion extending toward the ground plane is provided on the open end of the radiation element and an end of the extension portion serves as an open end, and a capacitance contributing to an electrical length of the high-frequency wavelength $\lambda_2$ is formed between the open end of the extension portion and the ground plane.

3. The antenna according to claim 2, wherein at least one of the feeding portion, the pair of short-circuit portions, and the extension portion is arranged so that its width changes continuously or stepwisely as it approaches from the peripheral edge portions of the radiation element to the ground plane.

4. The antenna according to claim 2, wherein a notch portion is provided in at least one of the peripheral edge portions, the pair of short-circuit portions, and the extension portion.

5. The antenna according to claim 1 or claim 2, wherein:

bent portions are provided on at least either one of the peripheral edge portions positioned at opposite sides with respect to the feeding portion at the one end of the radiation element where the feeding portion is provided or the ground plane facing the peripheral edge portions, the bent portions extending toward the ground plane or the peripheral edge portions, and the bent portions are spaced apart from the feeding portion and form matching elements to match an impedance of the feed circuit connected to the feeding portion with an impedance of the antenna.

6. The antenna according to claim 1 or claim 2, wherein matching slits arranged to match an impedance of the feed circuit connected to the feeding portion with an impedance of the antenna are provided in the radiation element at opposite sides of the feeding portion, the matching slits extending from the one end toward the other end of the radiation element.

7. The antenna according to claim 1 or claim 2, further comprising a circuit board on which the ground plane is disposed, said short-circuit portions being directly connected to said ground plane.

8. The antenna according to claim 7, wherein a dielectric substrate is provided between the ground plane and the radiation element.

9. A communication device comprising the antenna according to claim 7, an RF component on said circuit board being connected to said feeding portion.

10. A communication device comprising a circuit board including the ground plane, the antenna according to claim 1 or claim 2 being mounted on said circuit board with said pair of short-circuit portions connected to said ground plane.

* * * * *